US005381711A

United States Patent [19]

Truemner et al.

[11] Patent Number: 5,381,711

[45] Date of Patent: Jan. 17, 1995

[54] APPARATUS FOR PERFORATING CORRUGATED TUBING

[76] Inventors: Dale Truemner, 1390 S. Brown Rd., Pigeon, Mich. 48753; Richard Booms, 2581 Sand Beach Rd., Bad Axe, Mich. 48413

[21] Appl. No.: 70,073

[22] Filed: Jun. 1, 1993

Related U.S. Application Data

[63] Continuation-in-part of Ser. No. 831,690, Feb. 5, 1992, which is a continuation-in-part of Ser. No. 19,026, Feb. 18, 1993.

[51] Int. Cl.[6] ..... B26D 3/14

[52] U.S. Cl. ..... 83/318; 83/54; 83/698.61

[58] Field of Search ..... 83/54, 340, 672, 592, 83/318, 319, 507, 700, 303, 698.61

[56] References Cited

U.S. PATENT DOCUMENTS

| | | | |
|---|---|---|---|
| 627,462 | 6/1990 | Legg | 83/340 X |
| 1,510,729 | 10/1924 | Weisner | 83/340 X |
| 2,540,058 | 7/1948 | Stern | 83/340 X |
| 3,370,491 | 3/1966 | Cross | 83/54 X |
| 3,824,886 | 7/1974 | Hegler | 83/329 |
| 3,957,386 | 5/1976 | Lupke | 408/50 |
| 4,158,534 | 6/1979 | Hegler et al. | 83/54 X |
| 4,180,357 | 12/1979 | Lupke et al. | 409/131 |
| 4,218,164 | 8/1980 | Lupke et al. | 409/131 |
| 4,270,878 | 6/1981 | Fales | 409/143 |
| 4,486,929 | 12/1984 | Dickhut et al. | 83/318 X |
| 4,488,467 | 12/1984 | Hegler et al. | 83/303 |
| 4,587,874 | 5/1986 | Lupke et al. | 83/340 |
| 4,836,073 | 6/1989 | Castiglioni | 83/507 X |
| 5,097,576 | 3/1992 | Kadono et al. | 83/318 X |
| 5,241,887 | 9/1993 | Wolff et al. | 83/700 X |

*Primary Examiner*—Richard K. Seidel
*Assistant Examiner*—Kenneth E. Peterson
*Attorney, Agent, or Firm*—Weintraub, DuRoss & Brady

[57] ABSTRACT

A tubing perforating machine can perforate tubing at a high rate of speed. The perforator may also cut tubing of a higher rigidity, particularly dual wall tubing. This is achieved by facilitating the movement of the cutting wheels to compensate for production fluctuations of the tubing.

5 Claims, 6 Drawing Sheets

FIG 5
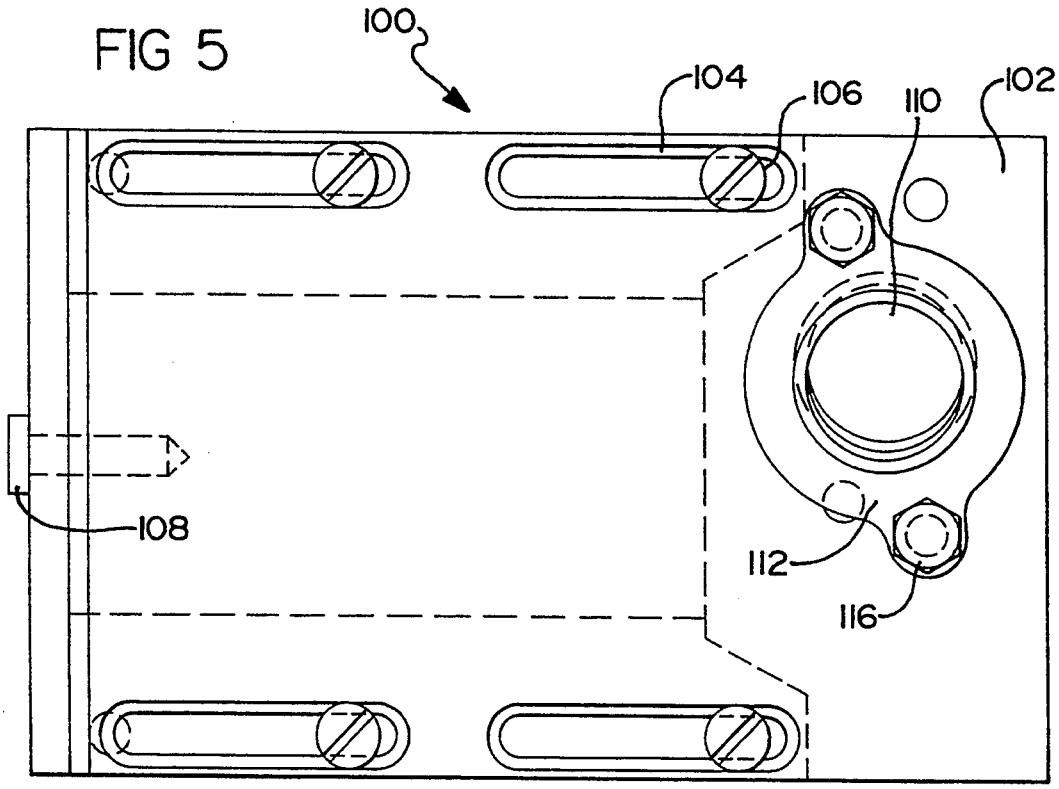
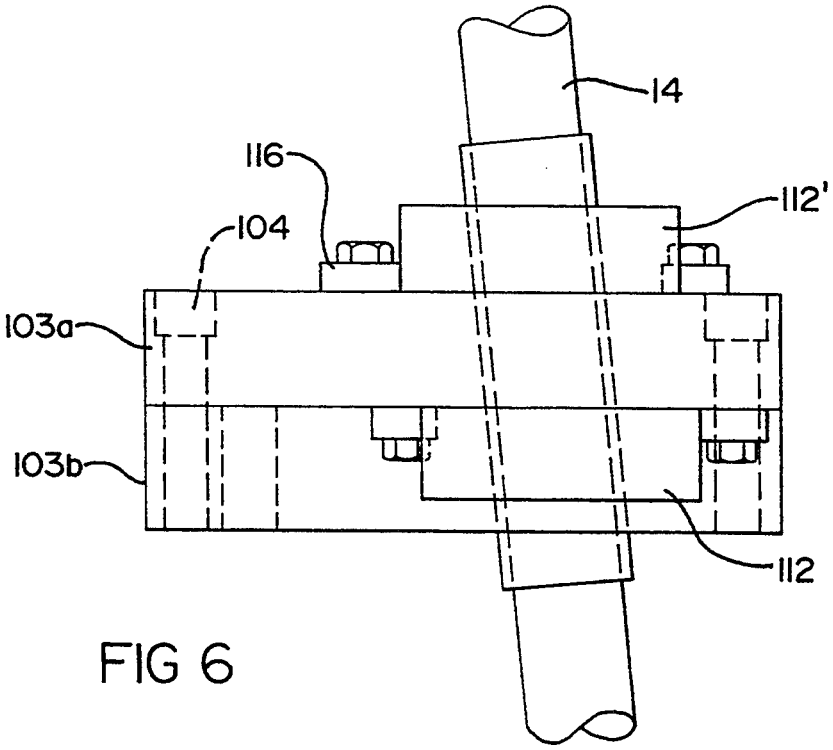
FIG 6

FIG 7
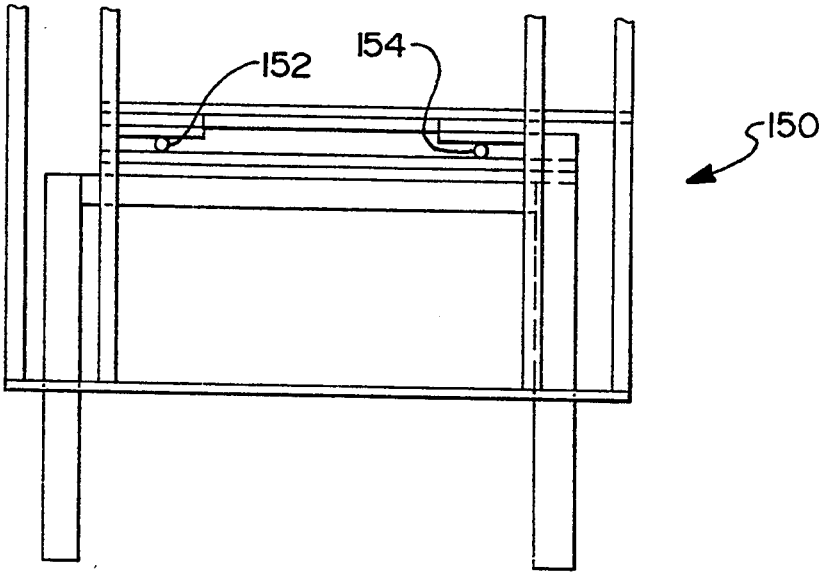
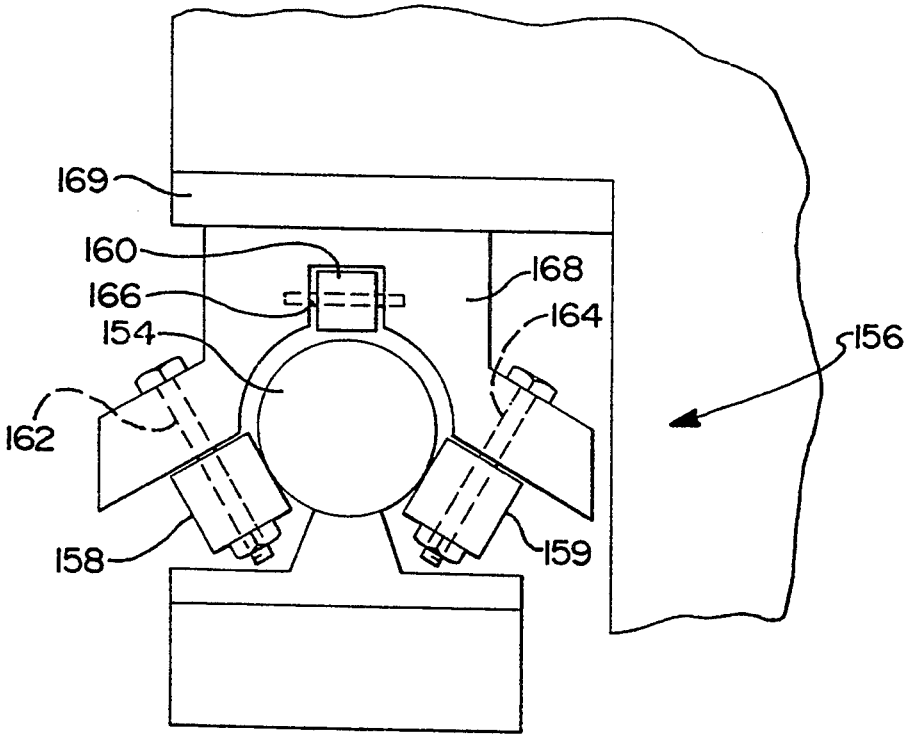
FIG 8

APPARATUS FOR PERFORATING CORRUGATED TUBING

This application is a continuation-in-part of co-pending U.S. patent application Ser. No. 07/831,690, filed Feb. 5, 1992, the disclosure of which is incorporated herein by reference, and U.S. patent application Ser. No. 08/019,026, filed Feb. 18, 1993, the disclosure of which is additionally incorporated herein by reference.

BACKGROUND OF THE INVENTION

1. Field of the Invention

The present invention concerns an apparatus for perforating corrugated tubing. More particularly, the present invention concerns the perforating dual wall corrugated tubing.

2. Prior Art

Machines for perforating tubing are known. U.S. Pat. No. 3,824,886 issued Jul. 23, 1974 to Hegler, teaches an apparatus for cutting apertures in corrugated tubing by rotating the cutter circumferentially around the tubing. The cutter is disposed within a ridge on a wheel, which is driven by a transmission. The wheel and cutter cooperate with a roller to rotate about the tubing. The cutter travels in an epitrochoidal path around the outer surface of the tubing, causing a perforation where the cutter strikes the tubing. Hegler achieves perforations perpendicular to the axis of the tubing by this method.

While offering a relatively simple design to achieve its ends, Hegler is necessarily limited to perforating corrugated tubing at relatively low speeds due to the necessity of the wheel and cutter traveling the entire length of the corrugation. Increasing the traveling speed of the wheel beyond modest levels would result in miscuts in the tubing, such as cuts in the side walls of the corrugation instead of the valley thereof. Further, excessive wheel speed would cause the wheel to jump past corrugations, thus missing areas of the tubing and leaving these areas unperforated. Hegler does not address the issue of perforating dual wall piping.

U.S. Pat. No. 4,180,357 issued Dec. 25, 1979 to Lupke et alia teaches an apparatus for perforating tubing. Lupke et alia teaches a machine having a plurality of lead screws for driving the tubing along an axial path, the lead screws meshingly engaging with the corrugations of the tubing. Each lead screw is mounted on an axis of rotation parallel to the axial path of the tubing. Mounted upon each lead screw is a cutter, flanked on each side by a raised rib. The cutter is in a plane substantially at a right angle to the axial path and the cutter intermittently intersects the tubing. Lupke achieves rotation of the lead screws by a system of gear wheels coordinated such that pairs of lead screws cut the tubing simultaneously. Lupke can achieve a maximum horizontal tubing speed of 20 feet per minute while cutting. At speeds greater than 20 feet per minute, the apparatus of Lupke experiences difficulty in realigning the cutter and properly perforating the tubing.

U.S. Pat. No. 4,218,164 issued Aug. 19, 1980 to Lupke et alia teaches an improvement upon the previous Lupke apparatus of the '357 patent. The plurality of lead screw members have a helically raised rib member mounted centrally thereon, the helical rib replacing the raised straight ribs of the previous apparatus. The cutter is disposed at the end of the helical rib. The helical rib tends to facilitate entry of the cutter into the valley of the corrugation. The rib extends around only a portion of the circumference of the shaft, thus continuing the teaching of intermittent intersection by the cutter as taught in the previous Lupke patent. This apparatus achieves a horizontal tubing speed of approximately 40 to 50 feet per minute. At speeds in excess of 50 feet per minute, the apparatus tends to climb the side walls of the corrugation and perforate either those walls or the crown of the corrugation.

The devices of the Lupke et alia patents overcome the limitation of rotating the entire cutter wheel around the tubing as taught by Hegler. In the first Lupke patent, the plurality of raised ribs essentially slowed the horizontal movement of the tubing long enough to effect the perforation. The apparatus of the second Lupke patent substituted the helical rib for the plurality of straight ribs. This alleviated the need to slow or stop the horizontal travel of the tubing along the axial path to effect the perforation, and works relatively well at lower speeds, i.e. speeds less than 50 feet per minute.

However, both Lupke apparatuses encounter serious problems when greater speeds are attempted. When operated at speeds in excess of 50 feet per minute, the cutter of the first Lupke apparatus is not able to spring back to its original start position for the next intermittent engagement of the tubing. Thus, the cutter is not able to perforate the valley of the corrugation, but rather cuts into the side wall, miscutting the tubing. Similar problems occur with the second Lupke apparatus.

Additionally, problems are encountered with the feed worms of Lupke. At high speeds, the vertical sides of the feed worms are unable to maintain their helical course in the corrugation. Thus, the worms tend to climb the side walls of the corrugations, crushing the crown of the tubing and skipping parts of the corrugation. These problems are amplified by attempts to cut non-flexible tubing, such as dual wall tubing.

Different problems are encountered when tubing is a dual wall construction. Dual wall tubing has corrugation on the outer surface thereof, while having a smooth, substantially hard inner cylindrical surface. Such tubing, having significantly greater rigidity, is more difficult to perforate.

Dual wall tubing, like other corrugated tubing, is often perforated immediately after being produced by an extrusion machine. The tubing comes at a non-constant rate due to the production process. This presents a potentially serious problems, since reductions or increases in tubing production will affect the tubing perforation. In flexible corrugated tubing, this problem is addressed by increasing or decreasing the cutting of the perforator by a potentiometer. If the tubing is increased at too great a speed, the cutting is increased. If the tubing is produced at a lesser rate, the cutting is slowed.

This solution is not available when cutting perforations in dual wall tubing. The hard inner surface eliminates flexibility. Thus, tubing will not bend down or move up with the changes in production. Rather, the rate fluctuations will affect either a pulling or a pushing on the machine perforating the tubing. This is a significant problem in perforating this tubing.

An additional problem encountered in perforating tubing is the imperfect shape of most piping. When tubing is injection molded, the mold is set to produced tubing of a circular cross-section. However, due to imperfections in the mold, equipment deterioration and malfunction, or the like, the tubing produced often is not perfectly cylindrical. In circumstances where the tubing is stored on huge rollers after formation, for some period of time before perforation, sagging of the tubing tends to distort the cylindrical shape into an elliptical or oblong shape. When such misshaped tubing is fed into tubing perforating machines, such as those identified herein above, the tubing is miscut. Specifically, whole sections of tubing are skipped, while the sections that are cut are not properly cut, i.e. perforations occur in the crown of the corrugation and not in the valley of a corrugation. Since this is a circumstance that occurs with regularity, it is incumbent to have a device which can perforate piping of imperfect dimensions.

Another problem related to misshapen tubing is tubing shrinkage. When corrugated tubing is injection molded, plastic resins, often salvaged from scrap or waste plastic, such as soft drink bottles, are melted and recast into the desired tubing shape. However, as is known, different resins will shrink varying amounts when the extruded tubing cools. This can lead to tubing of diameters slightly less than that anticipated by the perforating machine. This difference will affect the perforation of the tubing, absent means for adjusting to changes in tubing flow.

An additional factor of importance in perforating tubing is the deployment of the perforations. It is often desired for certain usages to deploy the perforations in evenly separated rows around the tubing. For example, six rows of perforations would be deployed at an angular spacing of 60 degrees between each row. However, in certain environments, it may be desirable to control the displacement of the perforations. For example, some European communities prohibit piping having perforations in the bottom third of the tubing to prevent dirt from entering the tubing. Due to buying practices that have become common, other people desire tubing with a minimum number of perforations, i.e. six or eight rows. Therefore, for a truly versatile perforation machine, it must be capable of handling different perforation specifications.

Therefore, it is a purpose of the present invention to provide a perforating apparatus that can adapt to slight variations in tubing size due to shrinkage of plastic resins.

It is a further purpose of the present invention to provide an apparatus for perforating tubing which can accommodate and cut tubing of an oblong or misformed cylindrical shape.

It is a still further goal of the present invention to cut tubing of higher rigidity, such as dual wall tubing.

It is a still further purpose of the present invention to provide a tubing perforator which can effect cuts in rows disposable at any setting desired.

It is to these ends that the present invention is directed.

SUMMARY OF THE INVENTION

The present invention defines an apparatus for cutting perforations in corrugated tubing as the tubing is passed along an axial path thereof, the apparatus comprising:

(a) at least one pair of feeder-cutter wheels, each wheel comprising a worm, a threading disposed upon the worm, and a plurality of cutters disposed within the threading, each wheel being adapted to continuously intersect the corrugation of the tubing;

(b) at least one pair of drive shafts, each drive shaft having one wheel axially mounted thereon;

(c) means for rotating the drive shafts;

(d) means for translating the drive shafts and the feeder-cutter wheels along the axial path;

(e) at least one pair of adjustable mounting plates, each drive shaft having an associated adjustable mounting plate, the plates having means for adjusting the position of the drive shaft relative to the axial path.

In a second embodiment, the present invention may singularly comprise the feature of the adjustable drive shafts. Thus, the second embodiment comprises:

(a) at least one pair of feeder-cutter wheels, each wheel comprising a worm, a threading disposed upon the worm, and a plurality of cutters disposed within the threading, each wheel being adapted to continuously intersect the corrugation of the tubing;

(b) at least one pair of drive shafts, each drive shaft having one feeder-cutter wheel axially disposed thereon, the drive shafts being deployed at an angle relative to the axial path of the tubing to apply pressure to the tubing as it is moved past the wheels;

(c) at least one pair of adjustable mounting plates, each drive shaft having an associated mounting plate therewith; and (d) means for connecting the mounting plate to a base portion of the apparatus.

In a third embodiment of the present invention, the apparatus may singularly comprise the improvement of a translatable cutting apparatus. Such an embodiment of the present invention would be an apparatus for perforating tubing as the tubing is passed along an axial path thereof, the apparatus comprising:

(a) at least one pair of feeder-cutter wheels, each wheel comprising a worm, a threading disposed upon the worm, and a plurality of cutters disposed within the threading, each wheel being adapted to continuously intersect the corrugation of the tubing;

(b) at least one pair of drive shafts, each drive shaft having one feeder-cutter wheel axially disposed thereon, the drive shafts being deployed at an angle relative to the axial path of the tubing to apply pressure to the tubing as it is moved past the wheels;

(c) means for rotating the drive shafts; and (d) means for translating the cutter wheels and drive shafts along a path parallel to the axial path of the tubing.

The present invention will be more clearly understood with reference to the accompanying drawings, in which like reference numerals refer to like parts, in which:

BRIEF DESCRIPTION OF THE DRAWINGS

FIG. 5 is a front view of an adjustable mounting plate of the apparatus of the present invention;

FIG. 6 is a top cross-sectional view of a drive shaft of the present invention being deployed through the adjustable mounting plate;

FIG. 7 is an end view of the apparatus of the present invention; and

FIG. 8 is a cross-sectional view of the apparatus of the present invention, wherein one rail of the means for translating is shown with one bearing disposed thereabout.

DETAILED DESCRIPTION OF THE PREFERRED EMBODIMENT

Figure 1:
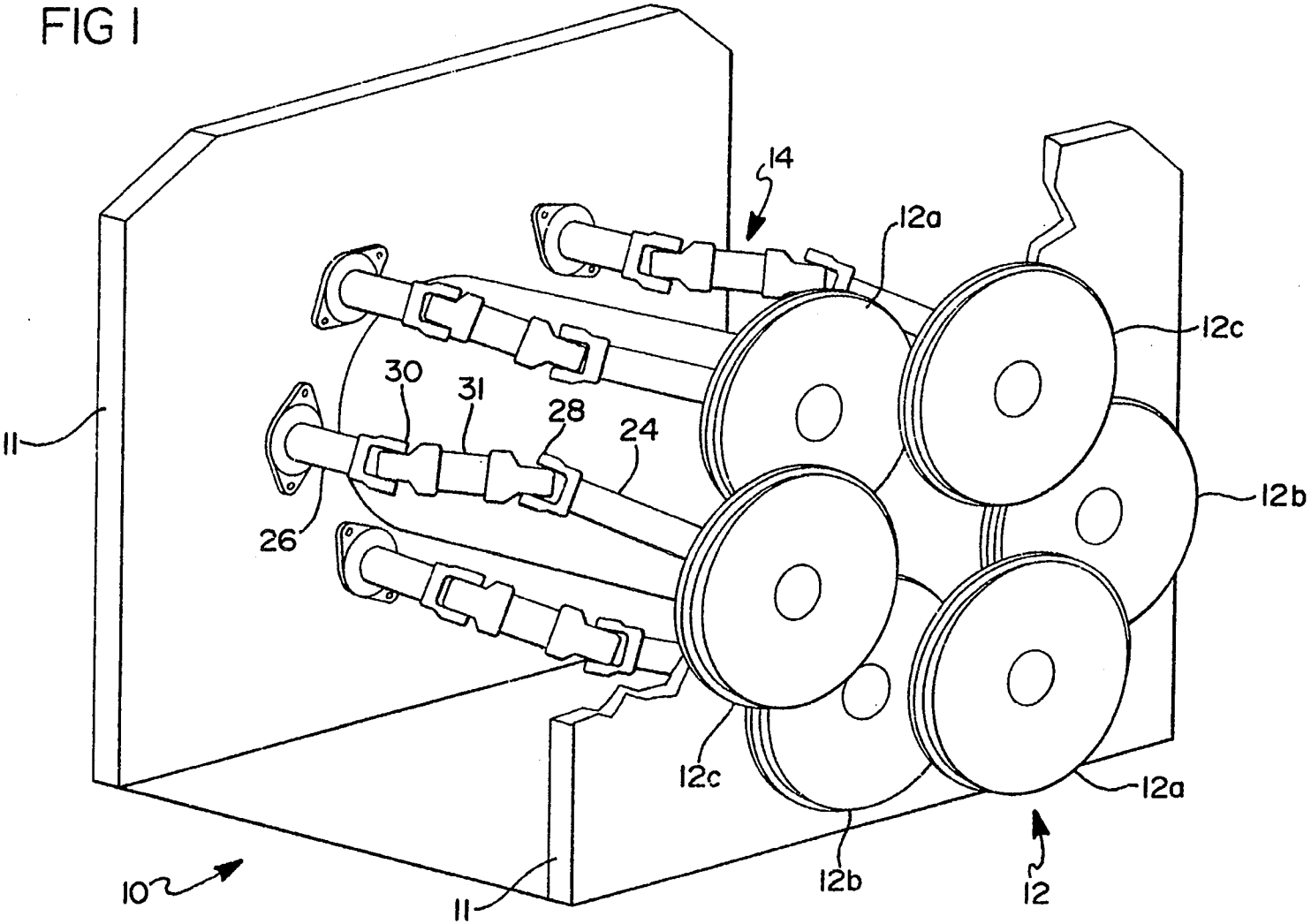
FIG. 1 is a perspective view of the first embodiment of the apparatus for perforating corrugated tubing, with a part of the housing cut away.

With reference now to FIGS. 1–4, there is shown therein an apparatus 10 for perforating corrugated tubing in accordance with the Applicants' previously filed and co-pending application, covering an apparatus for perforating tubing. Since the present invention is an improved version of this perforating apparatus, a discussion of the co-pending application will be undertaken herein to adequately discuss matters necessary for the understanding of the present improvements. The apparatus 10 comprises a plurality of feeder-cutter wheels 12, a plurality of drive shafts 14, and means 16 for rotating the drive shafts 14. The apparatus 10 further has a housing, including a universal mounting plate 11, for support of items mounted thereon.

The feeder-cutter wheels 12 comprise a worm 18, a rotatable shaft 19, a threading 20 and a cutter 22. In the more recent of Applicants' co-pending applications, the cutter 22 may be replaced by a plurality of cutters. The worm 18 comprises a solid cylindrical body, the diameter of which is determined by the size of the tubing T to be perforated. The worm 18 is forwardly joined on the rotatable shaft 19. The threading 20 is disposed helically upon the outer surface of the worm 18. The threading 20 facilitates the intersection and intermeshing of the wheel 12 with the corrugated tubing, indicated at T. The cutter 22 are disposed within the helical threading 20 on the outer surface of the worm 18. The cutter 22 are hardened and sharpened bits mounted into the worm 18, the cutter 22 having a hook extending slightly above the threading 20. As will be described further herein below, the threading 20 and the cutter 22 of the wheel 12 cooperate so as to concurrently drive the tubing T through the apparatus 10 and perforate the tubing T.

The wheels 12 are deployed in pairs on the machine 10. Specifically, the machine 10 commonly comprises two, three or four pairs of wheels 12. Where two or fours pairs of wheels 12 are utilized, each pair of wheels 12 is deployed to strike in the same plane of the tubing T. Additionally, each pair of wheels 12 in a two pair machine 10 will strike the tubing T, that is, all four wheels 12, will strike the tubing T in one plane. In a four pair or eight wheel machine, two pairs of wheels will strike the tubing in a first plane while the remaining four wheels will all strike the tubing in a second plane of the tubing. Where three pairs or six wheels are deployed, the wheels are deployed to strike the tubing in four distinct planes optimally.

Figure 3:
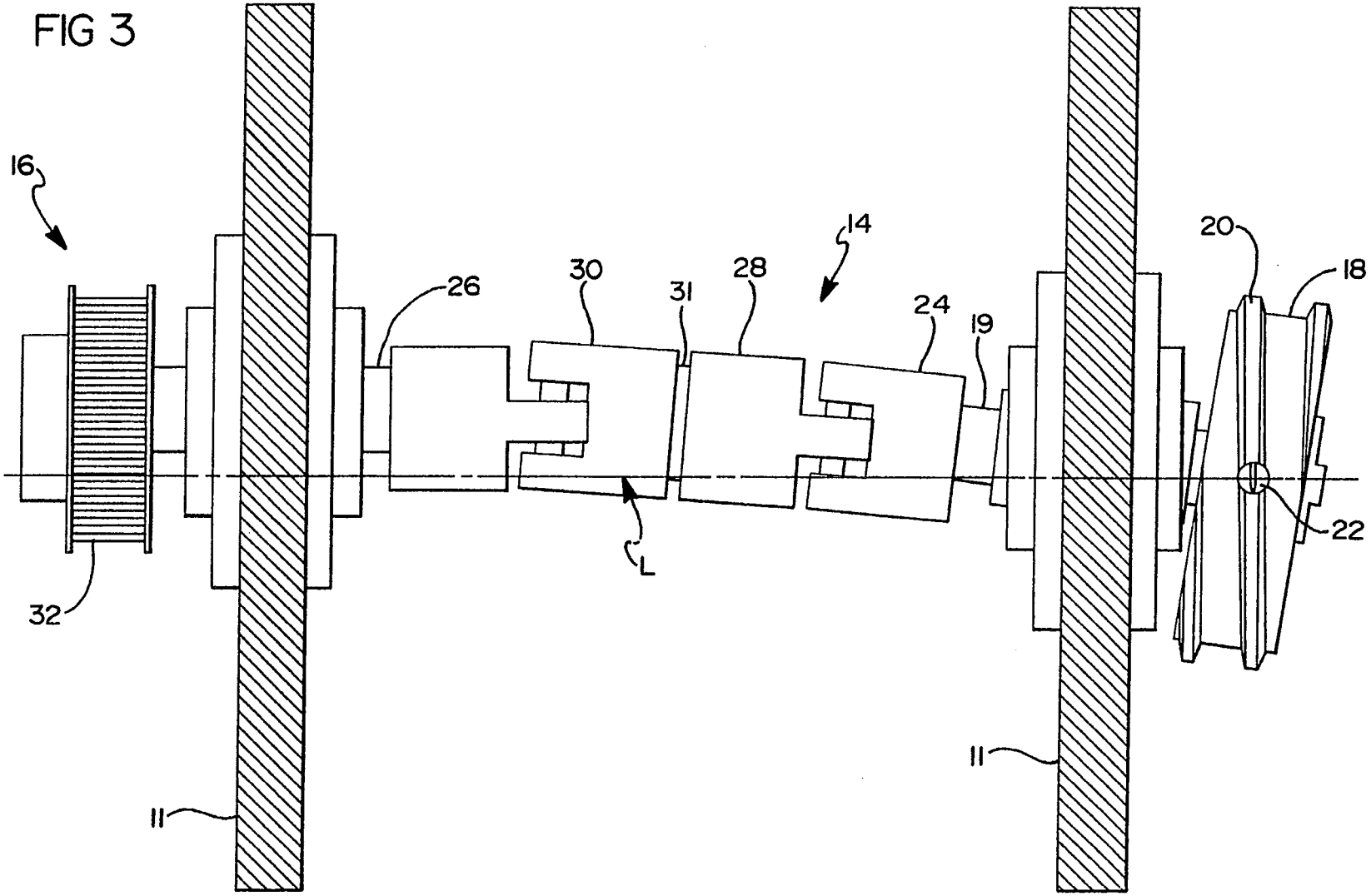
FIG. 3 is a top view of the feeder-cutter wheel and drive shaft of the first embodiment, the drive shaft having U-joints for angling the wheel and shaft.
Figure 4:
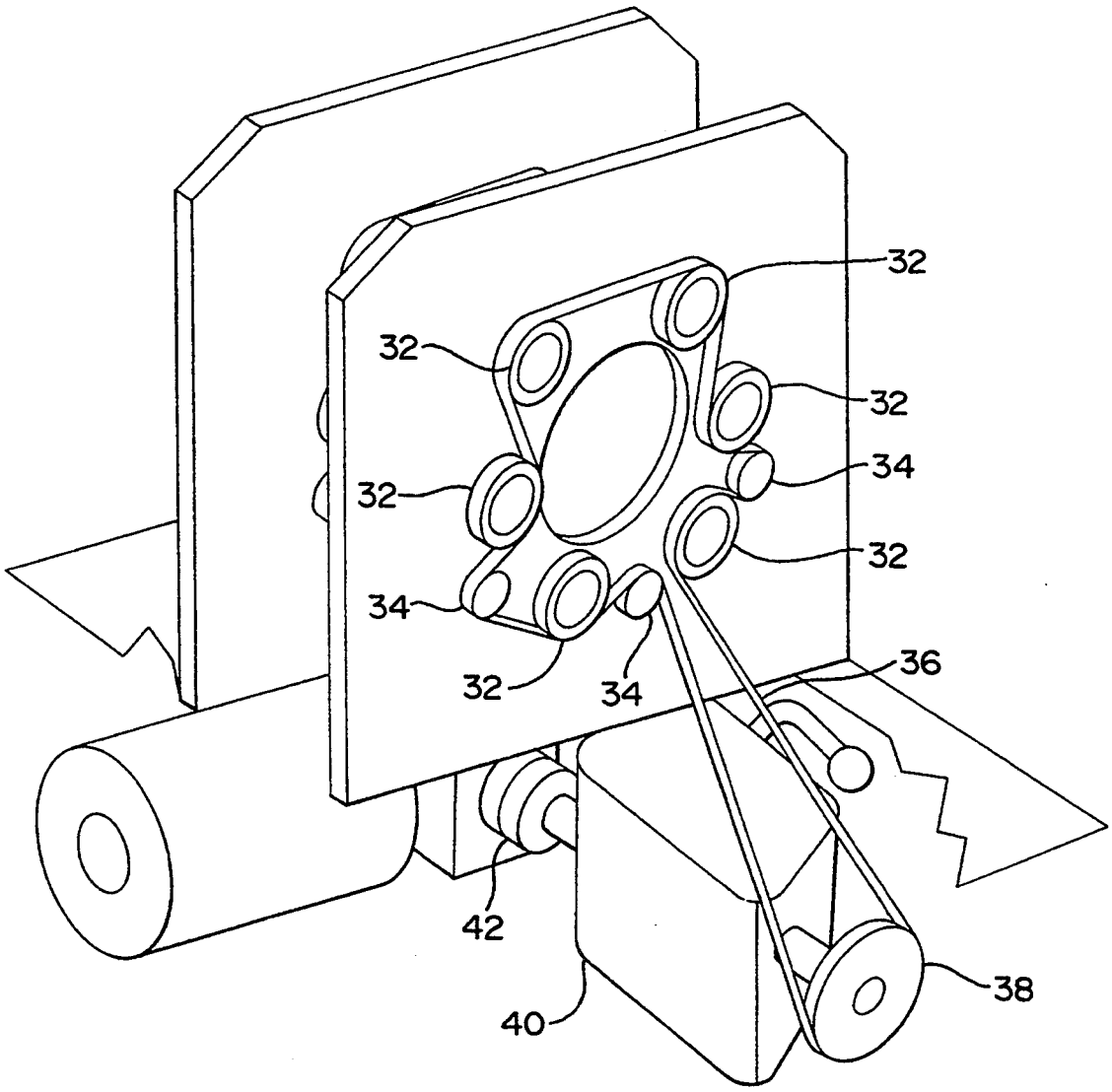
FIG. 4 is a rear view of the first embodiment, showing three pairs of drive wheels having a belt disposed therearound, the belt connected to means to driving.

Each wheel 12 is mounted upon a corresponding drive shaft 14. The drive shaft 14, in the preferred mode, comprises a forward portion 24, a rearward portion 26 and at least one U-joint 28 interconnecting the forward portion 24 and the rearward portion 26. As shown in FIG. 3, the forward portion 24 receives therein the rearward portion 26 of the rotatable shaft 19, thereby connecting the wheel 12 to the drive shaft 14. The forward portion 24 is then joined to a first U-joint 28. As shown in FIG. 3, the drive shaft 14 has two U-joints 28, 30. The first U-joint 28 is connected to a second U-joint 30 by an intermediate piece 31. The second U-joint 30 is connected to the rearward portion 26 of the drive shaft 14. The rearward portion 26 is connected to means for driving 18, as described herein further below.

Figure 2:
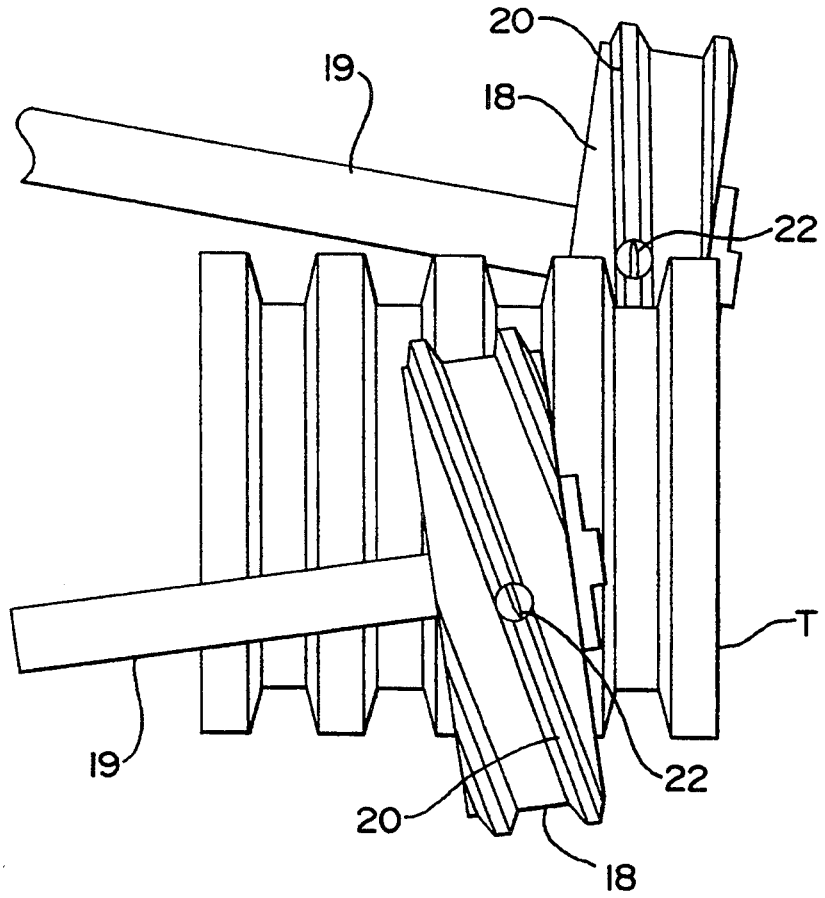
FIG. 2 is a side view of a pair of feeder-cutter wheels and drive shafts of the first embodiment of the present application deployed on a section of corrugated tubing, the wheels having a plurality of cutters deployed thereon.

The drive shaft 14 and the mounted feeder-cutter wheels 12 are offset at an angle relative to the axial path of the tubing T and the apparatus 10, the axis of the tubing T and the axis of the apparatus 10 being identical or coaxial and shown as L in FIG. 2. To achieve maximum speed in perforating the tubing T, the drive shaft 14 and corresponding wheel 12 are set at an angle substantially equal to the average of the helical angles of the threadings upon all of the feeder-wheels 12 to be deployed on the drive shafts 14 of the apparatus 10. In the typical apparatus 10, it has been found that such an angle supplies sufficient and necessary pressure by the wheel 12 to keep the threading 20 rotating through the corrugation of the tubing T. This then facilitates the perforation of the tubing T by the cutter 22 in the valley of the corrugation, and not in the side wall or crown of the tubing T.

Plastic corrugated tubing, as it is commonly and uniformly manufactured today, has the characteristic of being thickest at the valley of the corrugation and on the crowns of the corrugation. Thus, the side walls of the tubing are comparatively weak due to the manufacturing techniques utilized. This is particularly true of thicker tubing, which has a substantially increased thickness at the valley of the corrugation. Following the principle of seeking the path of least resistance, the known apparatuses for perforating tubing will often, and especially at speeds exceeding 50 feet per minute, miscut the tubing because the cutter cannot slit the thick plastic at the bottom of the corrugation. Thus, the tubing is cut on the side walls, or less commonly, on the crown.

This problem is accentuated in tubing of larger diameters. In such tubing, the pitch of the corrugations reach 2 inches and achieve valley thicknesses of 150/1000 inch. To perforate such tubing, known machines stick within a corrugation and then are thrown by the excessive torque over the crown and into forward corrugations. This can damage the tubing, but also the torque can damage the gear train and cutters of the perforating machines.

Additionally, it must be noted that the plastic corrugated tubing currently available on the market does not have any helical angle to its corrugations. Tubing with a helical angle was previously known, but none is known to be currently available or in use. The importance of the lack of a helical angle in the tubing relates to the cutting ability of previously known machines and the present invention.

It has been found that to most efficiently effect the offset angle, at least one U-joint is needed and normally two U-joints 28, 30 are desired. The U-joints 28, 30 allow for the achievement of the offset angle and transmission of rotational power, as is commonly known. One U-joint could, in some circumstances, be used. However, the use of a plurality of U-joints is preferred, as is known in the art.

Referring now again to FIG. 4, the means 18 for rotating the drive shaft 14 is seen, as comprising a plurality of drive wheels 32, a plurality of sprockets 34 and a belt 36. The drive wheels 32 are individually mounted upon each drive shaft 14 at the rearward portion 26 thereof. The belt 36 is wound around the drive wheels 32 and the sprockets 34. The sprockets 34 provide tension to keep the belt 36 in tight contact with the drive wheels 32 when in motion. The means 18 for rotating further comprises a transmission 40 in connection with an electric motor 42. The transmission has a drive train connected to a sprocket 38 or, alternately, to one of the drive wheels 32. This imparts the necessary energy to allow effective operation of the means 18 for rotating the drive shaft 14 and the wheels 12.

Referring again to FIG. 1, it is noted that the apparatus 10 has three pairs of feeder-cutter wheels, the wheels indicated generally at 12 and in pairs as 12*a*, 12*b* and 12*c*. The design of the apparatus 10 is such that the wheels 12 are disposed in five planes. Specifically, the worms 18 of the wheels 12 are disposed in distinct planes. A single wheel of the first pair 12*a* is in a first plane. The corresponding wheel of the first pair 12*a* is in a second plane. The wheels of the second pair 12*b* are both deployed in separate planes, but strike the tubing in the same plane. The wheels of the third pair 12*c* are both deployed in a separate plane, but strike the tubing in the same plane.

The design of spacing the wheels 12 in four different planes, as opposed to one plane, offers a significant advantage over previous apparatuses for perforating tubing. Specifically, the deployment of the wheels 12 in four planes allows for the use different sized wheels 12 on the same apparatus 10. Thus, one apparatus 10 may perforate tubing of various diameters.

In achieving this versatility, and as noted previously the apparatus 10 achieves this without requiring recalibration and resynchronization of the newly mounted wheels 12 and their associated drive shafts. This is due, in part, to the elimination of gears for driving the apparatus 10. Previously known apparatus 10 required new gear trains when deploying cutter wheels 12 of different sizes. The co-pending invention, also, fulfills the goal of being able to cut tubing of different sizes without recalibration. This is achieved by standardizing the drive shafts 14 for the receipt thereon of all worms 18, regardless of the size of wheels 12 mounted thereupon. It is recognized that cutting tubing T will require greater torque in the wheels 12 as the tubing T increases in diameter, for as the diameter increases the pitch and thickness of the plastic in the corrugation increases. Thus, the transmission set forth in the present invention is shiftable between various rpm (revolution per minute) settings. Therefore, where the tubing is of a smaller diameter, a higher speed is achieved and a higher transmission speed is elected. Alternately, when a thicker tubing of greater diameter is to be cut, smaller wheels 12 are mounted on the shaft 14 and a lower transmission speed is selected. This gives the wheels 12 greater torque and the needed power to cut through the thicker tubing T. The present invention eliminates the additional cost of new gear trains when switching to tubing of different diameter. As noted the present invention enables the cutting of different diameter tubings.

Each pair of wheels 12 is deployed such that the wheels 12*a* of each pair strike the tubing T and cut perforations therein at the same time. The first pair of wheels 12*a* strike concurrently to cut a first set perforations. The wheels 12*b* then strike the tubing T to cut a second set of perforations simultaneously and co-planarly. The wheels 12*b*, preferably, strike exactly 120° later than the wheels 12*a*. The wheels 12*c* then strike the tubing T cut a third set of perforations simultaneously and co-planarly, the wheels 12*c* striking 120° of rotation after the wheels 12*b* and 240° of rotation after the wheels 12*a*. The coordination of the wheels 12 produces six uniform lines of perforation along the length of the tubing T. Additionally, this coordination of cutters striking the tubing T reduces the torque required of the motor, as the power needs are spread evenly over the rotation of the wheels 12, and is not required in a greater amount only once a revolution. An example of one embodiment hereof contemplated is an eight feeder-cutter wheels having three cutters per wheel. This provides twenty-four cutters. The cutters are staggered so that only two cutters strike at any one time, so that the torque required to cut is lower than otherwise required.

The use of two or more threadings 19 can also be used in such a scheme, these multiple helixed wheels 12 being known as multi-start wheels. The use of multiple cutters 20 on the multi-start wheels results in a slower rotation and therefore a slower throughput of the tubing T. The present invention still achieves a speed well in excess of 50 feet per minute and, thus, provides a significant improvement over known machines. This cutting of the tubing T can be helped by synchronizing the striking of each pair of cutters thus lessening the load upon the drive equipment.

When a single start or single thread wheel 12 is deployed, the multiple cutters serve to cut into the same perforation being formed in the tubing T. Thus, each cutter serves to etch out a portion of the slit being made. This approach distributes the torque incurred when the cutting stroke occurs. This is superior to one cutter, since the torque incurred with one cutter is excessively high and affects the load put upon the motor and drive system. Thus, multiple cutters, which can be at least two, and as many as four, in the preferred embodiments and more than four in less preferred embodiments, achieve the cutting of greater diameter tubing at high speeds. Additionally, multiple cutters give a clearer slit and a cleaner opening.

It is also becoming popular in the art currently to produce dual wall tubing. Dual wall tubing is tubing having a corrugated outer surface and a smooth inner surface. Such tubing is useful, for example, in reinforcing storm sewers. This tubing has less flexibility than corrugated tubing. The present invention can cut such tubing easily, while the prior art machines, such as Hegler, cannot make the necessary perforations and stay within the grooves of the tubing. The lack of flexibility of the dual wall tubing accentuates the drawbacks of such prior art machines.

It is envisioned that the present invention will be capable of accommodating a range of tubing diameters, as desired by the user. Thus, one apparatus may perforate tubing of diameters between 2 inches and 6 inches, while a second machine may perforate tubing over a range of 4 inches to 8 inches in diameter, with various permutations permissible, as desired. The present invention eliminates the need for purchasing extra gear works to adapt an apparatus to tubing of different sizes. The additional set-up time needed to synchronize differing sizes of wheels is, also, eliminated. The user need only initially synchronize the device and purchase the feeder-cutter wheel sets corresponding to the desired diameters. Tubing of diameters within the range serviceable by a particular apparatus 10 can thus be perforated without an additional expenditure of time otherwise necessary in resetting the machinery or replacing the drive means, such as the gears in previous machines. Savings in time and expenses in additional machine parts are, therefore, realized.

Thus, by providing groups of wheels, each group having wheels of substantially the same diameter to be mounted upon the drive shafts 14, a user may have groups or sets to accommodate the different diameters of tubing to be corrugated by that machine. As noted, the machines must be restricted to accommodating three to five different diameters, otherwise requiring recalibration. Only wheels within the specifications of a machine may function to cut different sized tubing when mounted upon the drive shafts without recalibration. The apparatus 10 and the various groups of wheels 12 to cut the tubing without recalibration form a tubing corrugation set for perforating corrugated tubing of different diameter.

Although the present invention has been described herein with respect to a specific embodiment thereof, it will be understood that the foregoing description is intended to be illustrative, and not restrictive. Many modifications of the present invention will occur to those skilled in the art. All such modifications which fall within the scope of the appended claims are intended to be within the scope and spirit of the present invention.

Referring now to FIGS. 5–8, there is seen the preferred embodiment of the present invention, to wit, an improved apparatus for the perforation of tubing. The improvement comprises an adjustable mounting plate 100 and means for translating 150.

The adjustable mounting plate is best seen in FIG. 5 and comprises a flat member 102 having a plurality of slots 104 formed therein. The flat member 102 comprises a pair of sheets 103*a*, 103*b* which are joined together, as seen in FIG. 6. The slots 104 allow deployment therein of fasteners 106 which affix the adjustable mounting plates to the apparatus, particularly to a universal mounting plate 11, such as seen in FIG. 1. The fasteners may be loosened to allow the plate 100 to be shifted, ideally up to a distance of two inches. Such flexibility allows the shafts 14 to be moved slightly toward or slightly away from the axial path of the apparatus 10. By this means, the wheels 12 are adjusted relative to the tubing T to be cut. Therefore, tubing T that is slightly smaller than specified due to shrinkage or other reason may be properly cut by movement of the adjustable mounting plate 100. It is noted that the knob 108 helps facilitate this motion, and can be part of a mechanism (not shown) to incrementally move the plate 100 relative to the fasteners 106 and the tubing T. This mechanism could include a screw driven mechanism or other known systems of incremental movement.

The plate 100 further has an opening 110 formed therein for deployment therethrough of the shaft 14, as seen in FIG. 6. A bushing or ring 112 is fastened around the opening 110 with suitable fasteners, such as bolts shown at 116. A second bushing or ring 112' is also disposed thereon on the reverse side of the plate 100. The plate 100 is formed of metal or other suitable material.

Referring now to FIGS. 7 and 8, there is shown the means for translating 150 the cutting portion of the apparatus 10 during the perforation process. The cutting portion of the apparatus 10 comprises the wheels 12, the shafts 14, the adjustable mounting plates 100, if included, and the universal mounting plate 11. The means for translating 150 comprise a pair of rails 152, 154 upon each of which are mounted alinear bearings, indicated in FIG. 8 generally at 156, which are well known and can be replaced by suitable equivalents as are known. The rails 152, 154 ideally have two bearings mounted thereupon. Each rail 152, 154 is formed of hardened steel. Each bearing 156 comprises a plurality of rollers, shown as 158, 159, 160, each mounted upon a spindle 162, 164, 166. The bearing 156 allows for some slight shifting, such that at least two of the three rollers are always in contact with the rail 154. Each bearing 156 is substantially similar to that bearing 156 shown in FIG. 8. The rails 152, 154 are mounted to a support 168 of the apparatus to facilitate the riding of the bearings 156 thereon.

The means for translating 150 will now be described in terms of the movement of the apparatus during corrugation of dual wall tubing. When the tubing is extruded from a machine forming the tubing (not shown), the tubing will be fed into the apparatus. The cutting portion of the apparatus will be at the end of the rails closest the extrusion machine. At this end, the resting of the cutting portion thereat will toggle a kill switch, keeping all power from the apparatus.

When the tubing hits the feeder-cutter wheels, which are not yet turning, the cutting portion is pushed forward by the force of the tubing. This moves the cutting portion away from the rear end of the rails and disconnects the kill switch, allowing power to begin to flow in the apparatus. Thus, the wheels 12 begin turning, driving and cutting the tubing. As the tubing continues to be produced, the apparatus will ideally continue to cut and drive the tubing without reaching either end of the rails. If the tubing production slows significantly, the means for translating will reach the rear end, triggering the kill switch until enough pipe can be generated to warranted safe perforation. This prevents the perforating apparatus from drawing out newly produced tubing faster than it can be produced, preventing stretching of the pipe and potential snapping thereof.

If tubing is produced at too high a rate, then the tubing will push the cutting portion to the forward end of the rails. This will activate a second kill switch, which will shut down both the extrusion machine and the perforating machine. Thus, the apparatus will not be pushed too far forward if, for some reason, the tubing is being produced too rapidly. Due to the ability of the present and the co-pending apparatuses to cut tubing rapidly, such a situation is envisioned to catch operator error is setting the apparatus to cut at too slow a rate. By halting the process, the apparatus will have called user attention to the situation, which can then be remedied.

It is noted that, by use of the adjustable mounting plates to a universal mounting plate, wheels and shafts can be positioned at varying deployments. This can allow deployment of cutter wheels in locations of specific deportment, such as above a certain arc on the tubing. It may be necessary to utilize wheels of different diameters to achieve certain mixtures of perforation rows with certain tubing diameters.

Having, thus, described the invention, what is claimed is:

1. An apparatus for perforating tubing having corrugations and valleys therebetween, the apparatus comprising:

(a) at least one pair of feeder-cutter wheels, each wheel comprising a worm, a threading disposed upon the worm, and a plurality of cutters disposed within the threading, each wheel being adapted to continuously intersect the corrugation of the tubing, the threading being dimensioned to substantially fill the valley of the tubing;

(b) at least one pair of drive shafts, each drive shaft having one feeder-cutter wheel axially disposed thereon, the tubing having an axial path, the drive shafts being deployed at an angle relative to the axial path of the tubing to apply pressure to the tubing as it is moved past the wheels;

(c) at least one pair of substantially planar adjustable mounting plates, each drive shaft having an associated mounting plate therewith; and (d) means for connecting the mounting plate to a base portion of the apparatus.

2. An apparatus for perforating tubing having corrugations, the apparatus comprising:

(a) at least one pair of feeder-cutter wheels, each wheel comprising a worm, a threading disposed upon the worm, and a plurality of cutters disposed within the threading, each wheel being adapted to continuously intersect the corrugation of the tubing;

(b) at least one pair of drive shafts, each drive shaft having one feeder-cutter wheel axially disposed thereon, the tubing having an axial path, the drive shafts being deployed at an angle relative to the axial path of the tubing to apply pressure to the tubing as it is moved past the wheels;

(c) means for rotating the drive shaft;

(d) means for translating the cutter wheels and drive shafts along a path parallel to the axial path of the tubing comprising:

a pair of rails;

at least one bearing mounted upon each rail, the bearings being translatable along the rails; and means for connecting the bearing to the feeder-cutter wheels and drive shaft.

3. An apparatus for perforating tubing having corrugations and an axial path, the apparatus comprising:

(a) a first mounting plate;

(b) a second mounting plate;

(c) at least one pair of feeder-cutter wheels, each wheel comprising a worm, a threading disposed upon the worm, and a plurality of cutters disposed within the threading, each wheel being adapted to continuously intersect the corrugations of the tubing;

(d) at least one pair of drive shafts, each drive shaft having one feeder-cutter wheel axially disposed thereon, each drive shaft being supported by the first mounting plate and a second mounting plate, the drive shafts being deployed at an angle relative to the axial path of the tubing to apply pressure to the tubing as it is moved past the wheels;

(e) means for rotating the drive shafts; and (f) means for translating the feeder-cutter wheels and drive shafts along a path parallel to the axial path of the tubing, the means for translating confining the movement of the feeder-cutter wheels and drive shafts to a path parallel to the axial path of the tubing.

4. The apparatus of claim 3 further comprising:

at least one pair of adjustable mounting plates, each drive shaft having a mounting plate associated therewith, the plates having means for adjusting the position of the drive shaft relative to the axial path.

5. An apparatus for perforating tubing having corrugations, the apparatus comprising:

(a) at least one pair of feeder-cutter wheels, each wheel comprising a worm, a threading disposed upon the worm, and a plurality of cutters disposed within the threading, each wheel being adapted to continuously intercept the corrugation of the tubing;

(b) at least one pair of drive shafts, each drive shaft having one feeder-cutter wheel axially disposed thereon, the tubing having an axial path, the drive shafts being deployed at an angle relative to the axial path of the tubing to apply pressure to the tubing as it is moved past the wheels;

(c) at least one pair of adjustable mounting plates, each drive shaft having a mounting plate associated therewith; and (d) means for connecting the mounting plate to a base portion of the apparatus comprising:

a universal mounting plate, each adjustable mounting plate being connected thereto, the adjustable mounting plates each having a bushing thereon that allows the drive shaft to pass therethrough, the adjustable mounting plate having a plurality of slots formed therein and having a fastener deployed within each slot and connected to the universal mounting plate.

* * * * *